US010609471B2

(12) United States Patent
Cao

(10) Patent No.: US 10,609,471 B2
(45) Date of Patent: Mar. 31, 2020

(54) SPEAKER MODULE AND SOUND-ADSORBING MATERIAL

(71) Applicant: Goertek Inc., Weifang, Shandong (CN)

(72) Inventor: Xiaodong Cao, Weifang (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 16/076,474

(22) PCT Filed: Dec. 21, 2015

(86) PCT No.: PCT/CN2015/098051
§ 371 (c)(1),
(2) Date: Aug. 8, 2018

(87) PCT Pub. No.: WO2017/028434
PCT Pub. Date: Feb. 23, 2017

(65) Prior Publication Data

US 2019/0158951 A1 May 23, 2019

(30) Foreign Application Priority Data

Aug. 19, 2015 (CN) ..... 2015 1 0510460

(51) Int. Cl.
*H04R 1/28* (2006.01)
*G10K 11/162* (2006.01)
(Continued)

(52) U.S. Cl.
CPC ..... *H04R 1/288* (2013.01); *G10K 11/002* (2013.01); *G10K 11/162* (2013.01); *H04R 1/025* (2013.01); *H04R 9/025* (2013.01); *H04R 9/06* (2013.01)

(58) Field of Classification Search
CPC ..... H04R 2499/11; H04R 1/28; H04M 1/035
(Continued)

(56) References Cited

U.S. PATENT DOCUMENTS 4,646,872 A * 3/1987 Kamon ..... H04R 1/225 181/129
8,110,692 B2 * 2/2012 Bellussi ..... C01B 33/44 556/9
(Continued)

FOREIGN PATENT DOCUMENTS

CN 103098490 A 5/2013
CN 204069330 U 12/2014
(Continued)

OTHER PUBLICATIONS

WIPO, First Search report issued for PCT international application No. PCT/CN2015/098051.
(Continued)

*Primary Examiner* — Alexander Krzystan
(74) *Attorney, Agent, or Firm* — Houtteman Law LLC

(57) ABSTRACT

The invention provides a speaker module and a sound-adsorbing material, comprising: a housing and a speaker unit accommodated in the housing, wherein the speaker unit separates a cavity formed by the housing into a front sound cavity and a rear sound cavity; the rear sound cavity is filled with a sound-adsorbing material; and heteroatoms are doped in a crystal structure of the sound-adsorbing material. The application of the above invention can reduce the adsorption of alien molecules by the sound-adsorbing material inside the speaker module, and even reject the alien molecules, thereby ensuring the long-term effectiveness of the sound-adsorbing material and improving the stability of the acoustic performance of the speaker module.

13 Claims, 3 Drawing Sheets

(51) Int. Cl.

| | |
|---|---|
| ***H04R 9/06*** | (2006.01) |
| ***G10K 11/00*** | (2006.01) |
| ***H04R 1/02*** | (2006.01) |
| ***H04R 9/02*** | (2006.01) |

(58) Field of Classification Search
USPC ..... 381/348, 337, 345, 346, 177, 354
See application file for complete search history.

(56) References Cited

U.S. PATENT DOCUMENTS

| | | | | |
|---|---|---|---|---|
| 2003/0096632 | A1* | 5/2003 | Kim | H04M 1/035 455/550.1 |
| 2017/0041701 | A1* | 2/2017 | Cheng | H04R 1/02 |
| 2017/0274322 | A1* | 9/2017 | Janssens | B01D 53/9418 |

FOREIGN PATENT DOCUMENTS

| | | |
|---|---|---|
| CN | 204291362 U | 4/2015 |
| CN | 104703688 A | 6/2015 |

OTHER PUBLICATIONS

China Patent Office, first office action issued for Chinese patent application No. 201510510460.3.
WIPO, Supplementary Search report issued for PCT international application No. PCT/CN2015/098051.
China Patent Office, second office action issued for Chinese patent application No. 201510510460.3.
WIPO, International Search Report dated May 13, 2016 for PCT international application No. PCT/CN2015/098051.
WIPO, Written Opinion of the International Search Authority dated May 13, 2016 for PCT international application No. PCT/CN2015/098051.

* cited by examiner

SPEAKER MODULE AND SOUND-ADSORBING MATERIAL

CROSS-REFERENCE TO RELATED APPLICATIONS

This application is a continuation of International Application No. PCT/CN2015/098051, filed on Dec. 21, 2015, which claims priority to Chinese Patent Application No. 201510510460.3, filed on Aug. 19, 2015, both of which are hereby incorporated by reference in their entireties.

TECHNICAL FIELD

The present invention relates to the field of acoustic technology, and more particularly, to a speaker module and a sound-adsorbing material.

BACKGROUND

With the progress of the society and the development of technology, wearable electronic products have become increasingly lighter and thinner, and traditional sound-adsorbing materials have failed to meet the demand for tuning and calibrating acoustic performance of speakers in the miniature speaker industry. Therefore, people begin to constantly try or develop new types of sound-adsorbing materials. It has been verified that placing a porous sound-adsorbing material in the rear acoustic cavity of the speaker device can effectively improve the acoustic performance of the speaker.

At present, commonly used new sound-adsorbing materials with good effects include natural zeolite, activated carbon, white carbon black, sepiolite fibers, artificial synthetic zeolite powder with a silica-alumina mass ratio of 200 or more, or a mixture of the above materials. Although the above sound-adsorbing material has a good effect of improving the acoustic performance of the speaker, it has been found during the later long-term (from several hours to dozens of days) application monitoring process that the above sound-adsorbing material has serious failure problems, especially in extreme environments (in environments with a high temperature, high humidity, an organic volatile solvent atmosphere and the like), the speed and extent of failure are more apparent.

Therefore, there is an urgent need for a speaker module that is filled with a special sound-adsorbing material in the rear sound cavity to ensure long-term stability of the acoustic performance of the speaker in various environments.

SUMMARY

In view of the above problems, an object of the present invention is to provide a speaker module to solve the problem that the current sound-adsorbing material inside the speaker cannot be used for a long period of time, and the sound absorption deteriorates and may even fail.

The speaker module provided by the present invention includes a housing and a speaker unit accommodated in the housing. The speaker unit separates the cavity formed by the housing into a front sound cavity and a rear sound cavity, wherein a sound-adsorbing material is filled in the rear sound cavity; heteroatoms are doped in a crystal structure of the sound-adsorbing material, wherein The heteroatoms are sodium ions or arsenic ions.

The heteroatoms generate a repulsive force on alien molecules adsorbed by the sound-adsorbing material.

The sound-adsorbing material is one or a mixture of two or more of natural zeolite, activated carbon, white carbon black, sepiolite fibers, zeolite powder.

The sound-adsorbing material is doped with heteroatoms by a replacement method or hydrothermal synthesis method.

The heteroatoms partially replace original elements in the sound-adsorbing material or fill the defective elements in the sound-adsorbing material.

A compound containing heteroatoms is added in a sound-adsorbing material and a curing reaction is performed.

A compound containing heteroatoms is added to a raw material for synthesizing the sound-adsorbing material, and a crystallization reaction is performed.

A sound hole is provided on the housing, the front sound cavity communicates with the sound hole, and the rear sound cavity is sealed; a damping hole is arranged on a position of the housing corresponding to the rear sound cavity, and a damping net is arranged at a position of the housing corresponding to the damping hole.

The speaker unit comprises a unit housing, a magnetic circuit system accommodated in a cavity formed by the unit housing, and a vibration system. The magnetic circuit system includes a magnetic conduction yoke fixed to the unit housing, a magnet disposed at a central position of the magnetic conduction yoke, and a washer arranged on one side of the magnet far away from the magnetic conduction yoke. The vibration system includes a vibrating diaphragm, a voice coil fixed on one side of the vibrating diaphragm, and a reinforcing part fixed at a central position of the vibrating diaphragm.

With the speaker module according to the present invention described above, particular heteroatoms are intentionally doped into the crystal structure of the sound-adsorbing material to replace part of the atoms in the sound-adsorbing material or to dispose the heteroatoms in the lattice of the sound-adsorbing material (a space grillwork where atoms are orderly arranged in crystals), and a repulsive force exerted on the adsorbed alien molecules by specific heteroatoms prevents the adsorption of alien molecules by the sound-adsorbing material or reduces the adsorption degree of the alien molecules and ensures that the performance does not fail during use. This will ensure long-term stability of the acoustic performance of the speaker module.

To achieve the foregoing and related objectives, one or more aspects of the present invention include the features hereinafter specifically described and particularly pointed out in the claims. The following description and accompanying drawings set forth in detail certain illustrative aspects of the present invention. However, these aspects are indicative of only a few of the various ways in which the principles of the invention may be employed. In addition, the present invention is intended to include all these aspects and their equivalents.

BRIEF DESCRIPTION OF THE DRAWINGS

By reference to the following description in combination with the drawings and the claims, and with a fuller understanding of the present invention, other objects and results of the present invention will be clearer and easily understood. In the drawings:

FIG. 2-1 is a sectional view of a speaker module according to a first embodiment of the present invention;

FIG. 2-2 is a top view of a speaker module according to a first embodiment of the present invention;

FIG. 3-1 is a sectional view of a speaker module according to a second embodiment of the present invention;

FIG. 3-2 is a top view of a speaker module according to a second embodiment of the present invention.

Figure 1:
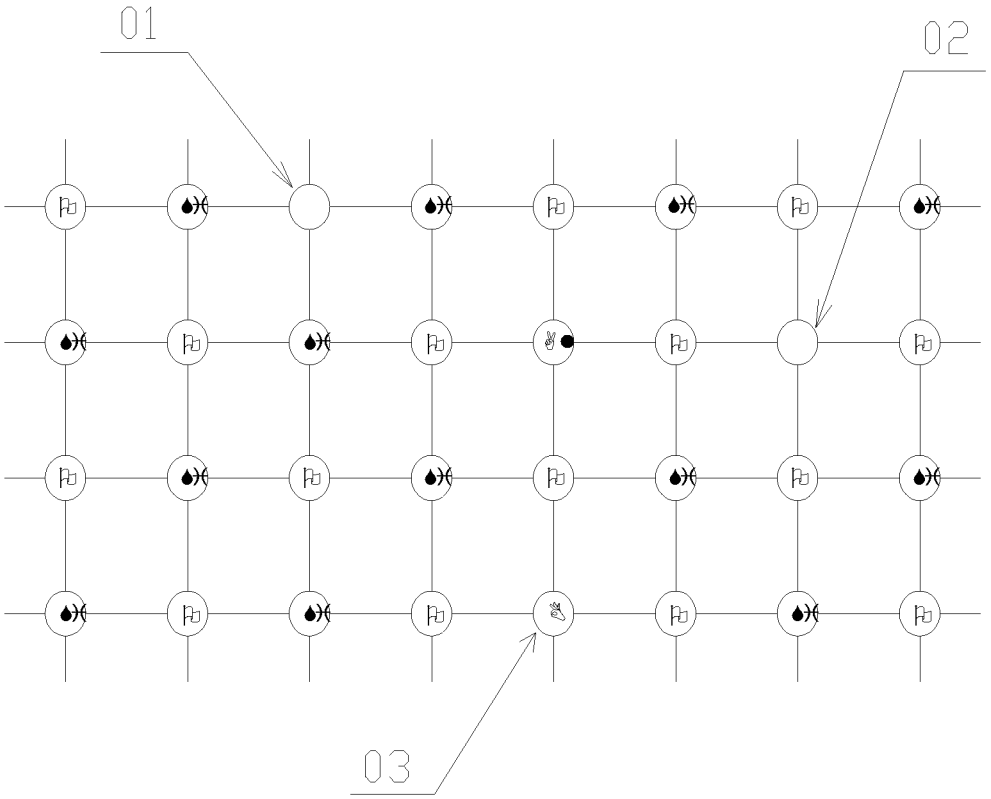
FIG. 1 is a schematic view of a crystal structure of zeolite powder according to a first embodiment of the present invention.

The reference numerals include: oxygen defect 01, silicon defect 02, heteroatom 03, steel sheet 1, 1', housing 2, 2', sound-adsorbing material 3, 3', damping hole 4, 4', and isolation net 5, 5'.

The same reference numbers in all drawings indicate similar or corresponding features or functions.

DETAILED DESCRIPTION

In the following description, for the purposes of explanation, numerous specific details are elaborated in order to provide a thorough understanding of one or more embodiments. However, it is apparent that these embodiments may also be implemented without these specific details. In other instances, well-known structures and devices are shown in block diagrams in order to facilitate description of one or more embodiments.

At present, sound-adsorbing materials easily adsorb alien molecules (for example, solvents such as ethanol, and aromatic hydrocarbon volatiles of small molecules, etc.), and thus cause blockages in microscopic pore-channel structures thereof, and cannot be desorbed rapidly in a short time, thereby causing irreversible failure in improving acoustic performance of the speaker by the sound-adsorbing materials.

Further, from the microscopic point of view, it is inevitable that heteroatoms or missing atoms enter the crystal system of the sound-adsorbing material during the crystal growth process of the sound-adsorbing material, or there exists a lattice defect during the crystal growth of the sound-adsorbing material crystal. These abnormal points will cause instable crystal charge distribution, form a "defective point" with a polarity, further cause the sound-adsorbing material (or sound-adsorbing particles) to easily adsorb alien molecules in the course of use and not to easily be desorbed, and eventually result in performance failure in the sound-adsorbing material.

To this end, the present invention intentionally "dopes" certain heteroatoms into the crystal structure of the sound-adsorbing material to replace the original atoms of the sound-adsorbing material or to fill up the defect points of the sound-adsorbing material. Through the repulsive force generated by these specific heteroatoms to the adsorbed alien molecules, the sound-adsorbing material does not adsorb alien molecules or to some extent reduce the degree of adsorption of alien molecules, thereby ensuring that the sound-adsorbing material will not gradually fail during use.

To describe in detail the speaker module and the method of doping the heteroatoms in the sound-adsorbing material of the present invention, specific embodiments of the present invention will be described in detail below with reference to the accompanying drawings.

The speaker module of the embodiment of the present invention includes a housing and a speaker unit accommodated in the housing. The speaker unit separates a cavity formed by the housing into a front sound cavity and a rear sound cavity. A sound-adsorbing material is filled in the rear sound cavity of the speaker module, and specific heteroatoms are doped in the crystal structure of the sound-adsorbing material to ensure long-term effectiveness of the sound-adsorbing material.

Specifically, in a specific embodiment of the present invention, the sound-adsorbing material may be one or a mixture of two or more of natural zeolite, activated carbon, white carbon black, sepiolite fibers, artificial synthetic zeolite powder having a silica-alumina mass ratio of 200 or more; heteroatoms may be sodium ions or arsenic ions, etc. Here, the type of heteroatoms added to the sound-adsorbing material is determined based on the type of the alien molecules adsorbed by the sound-adsorbing material, as long as it can be ensured that the incorporation of heteroatoms does not have an excessive effect on the performance of the sound-adsorbing material, and heteroatoms capable of making the sound-adsorbing material generate repulsion to the adsorbed alien molecules can be added to the sound-adsorbing material. Specifically, the heteroatoms may be adjusted and replaced correspondingly according to difference in the production requirements and the use environment of the speaker module, and are not specifically limited in the present invention.

As an example, the speaker module of the present invention and the heteroatoms doped in the sound-adsorbing material thereof will be described in detail in the following by taking the sound-adsorbing material of zeolite powder with a silica-alumina mass ratio of 200 or more as an example.

Specifically, FIG. 1 shows a crystal structure of a zeolite powder having a silica-alumina mass ratio of 200 or more according to an embodiment of the present invention.

In a specific embodiment of the present invention, doping mainly refers to utilizing other elements or atomic groups with properties similar to that of silicon and aluminum to partially replace the silicon and aluminum in the zeolite frame, or fill up defective elements to form a new frame. Specifically, the method for doping the heteroatoms in the sound-adsorbing material mainly includes the following two methods: a replacement method and a hydrothermal synthesis method.

Among them, the replacement method is mainly to place a highly volatile compound containing a doping atom and the zeolite powder in a certain temperature environment for solid-phase reaction; the synthesis method is mainly to add a compound containing a doping element to the synthetic raw material at a certain temperature to perform the crystallization reaction. The purpose of doping with heteroatoms mainly includes two aspects: on one hand, due to the fact that crystal materials (sound-adsorbing materials) cannot be perfectly latticed during the growth process, there must be some missing atoms. The missing sites are relatively strong in activity, quite easy to adsorb and combine with alien molecules, and are difficult to desorb, thus results in failure in improving acoustic performance of the speaker by the sound-adsorbing material. At this time, the purpose of doping the heteroatoms is to make up for the defective sites of the sound-adsorbing material crystal and reduce the absorption of the alien molecules by the sound-adsorbing material.

As shown in FIG. 1, the microscopic crystal structure of the zeolite powder having a silica-to-alumina mass ratio of 200 or more is a silica tetrahedron and an alumina tetrahedron. During the crystal growth process, lattice defects are easily caused, such as oxygen defect 01 or silicon defect 02 etc. illustrated in FIG. 1. These "defective points" cause instability of the charge distribution of the zeolite powder crystal, so that the sound-adsorbing material can easily adsorb alien molecules (for example, glue volatiles inside the speaker, etc.) in the surrounding environment, thereby causing the crystal channel to be blocked, destroying the microstructure of the material, and easily leading to a failure in the sound-adsorbing performance during the long-term use. In order to make up for the sites of the defective points, the sound-adsorbing material is doped with a heteroatom 03, and the lattice defects of the sound-adsorbing material are filled by the heteroatom 03, that is, the oxygen defect 01 and the silicon defect 02 are filled with heteroatoms, so as to reduce adsorption and combination of alien molecules by the sound-adsorbing material and ensure long-term effectiveness of its sound-adsorbing performance.

On the other hand, most of the alien molecules are polar molecules. While in the alumina tetrahedron of zeolite material, aluminum shows positive tervalence, therefore the alumina tetrahedron will carry a negative charge, and the zeolite material can easily adsorb alien molecules. By doping specific heteroatoms, the polarity of the sound-adsorbing material is changed or canceled so that the zeolite material generates a repulsive force to the alien molecules. The alien molecules cannot adsorb the material, which can ensure that the microscopic pore-channel structure of the sound-adsorbing material is unblocked, the sound-adsorbing material does not gradually fail during use, and further the stability of the new type of sound-adsorbing material in improving acoustic performance of the miniature speaker products is improved.

Specifically, the following process of performing heteroatom doping to the sound-adsorbing material is described in detail with reference to specific embodiments.

Embodiment 1

Figures 1, 2:
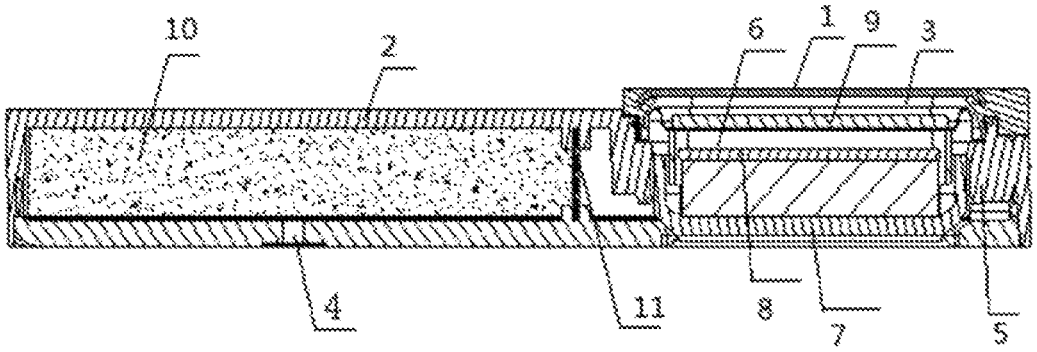
Figure 2:
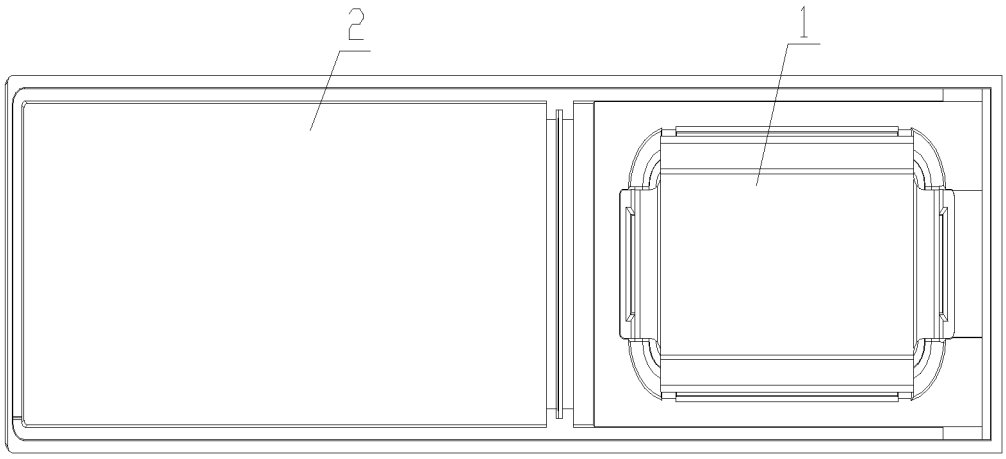

FIG. 2-1 shows a cross-sectional structure of a speaker module according to a first embodiment of the present invention. FIG. 2-2 shows a top view of a structure of a speaker module according to a first embodiment of the present invention.

As shown in FIGS. 2-1 and 2-2, the speaker module according to the first embodiment of the present invention comprises a housing 2 and a speaker unit 3 accommodated in the housing 2. A sound hole is provided on the housing 2. In order to enlarge the size of the speaker magnetic circuit system, a steel sheet 1 is injection-molded on the housing 2. The speaker unit is housed in a cavity formed by the housing 2 and the steel sheet. The front sound cavity communicates with the sound hole, and the rear sound cavity is sealed. A damping hole 4 is arranged at a position on the housing 2 corresponding to the rear sound cavity, and a damping net is arranged at the position of the housing 2 corresponding to the damping hole 4 to prevent the outside small particulate pollutants from entering the interior of the speaker unit. At the same time, a direct impact to the vibrating diaphragm by the air flow can be avoided to ensure the acoustic performance of the speaker unit during use.

The speaker unit comprises a unit housing 5, a magnetic circuit system 6 accommodated in a cavity formed by the unit housing 5, and a vibrating system. The magnetic circuit system 6 includes a magnetic conduction yoke 7 fixed to the unit housing 5, a magnet disposed at the center of the magnetic conduction yoke 7, and a washer 8 arranged on a side of the magnet far from the magnetic conduction yoke 7. The vibrating system includes a vibrating diaphragm, a voice coil fixed on one side of the vibrating diaphragm, and a reinforcing part 9 fixed at the center of the vibrating diaphragm. The rear sound cavity 3 is filled with a sound-adsorbing material 10 doped with heteroatoms, and is isolated from the cavity which is not filled with the sound-adsorbing material 3 by a partition net 11.

In the first embodiment, the sound-adsorbing material 10 is zeolite powder having a silica-alumina mass ratio of 200 or more. The sound-adsorbing material 10 is directly filled into the rear sound cavity of the speaker module, and is doped with sodium ions by the sodium ion replacement method. The conditions for reliability test of the speaker module are as follows: thirty sample speaker modules (the rear sound cavity of each speaker module sample is filled with a sound-adsorbing material 10 doped with sodium ions), thirty speaker modules with unfilled rear sound cavities, and thirty speaker modules with the rear sound cavities filled with common sound-adsorbing materials, and all are energized at 50° C. for 48 hours. The comparison of the test results (the average value of thirty test results are taken respectively) is shown in Table 1 below:

TABLE 1

| Speaker module | F0; unfilled with sound-adsorbing material (Unit: Hz) | Filler material type | F0; filled with sound-adsorbing material (Unit: Hz) | After high-temperature energization (Unit: Hz) |
|---|---|---|---|---|
| 1 | 1002 | undoped with heteroatoms | 863 | 908 |
| 1 | 1004 | doped with heteroatoms | 871 | 889 |

From the comparison results in Table 1, it can be seen that the new sound-adsorbing material 10 after being doped with sodium ions slightly reduces the effect in improving the acoustic performance of the speaker module (F0 becomes higher by 8 Hz), but from the results of the reliability test (high-temperature power-on),the failure rate of the speaker modules filled with a sound-adsorbing material undoped with sodium ions is about 32%, and the failure rate of speaker modules filled with a sound-adsorbing material doped with sodium ions is only 13%. It can be seen that the sound-adsorbing material after heteroatom doping treatment is significantly more stable than the untreated sound-adsorbing material during use of the speaker module.

The results of elemental analysis of the sound-adsorbing material before and after being doped with sodium ions are shown in Table 2 below:

TABLE 2

| Element | Before sodium ions are doped (wt %) | After sodium ions are doped (wt %) |
|---|---|---|
| C | 17.07 | 0 |
| O | 43.41 | 53.06 |
| Na | 0.14 | 0.53 |
| Al | 0.32 | 0 |
| Si | 39.06 | 46.41 |
| Total: | 100.00 | 100.00 |

It can be seen from Table 2 that the content of sodium element in the sound-adsorbing material after the sodium ion replacement treatment is significantly increased, and the repelling ability of the sound-adsorbing material against alien molecules also becomes stronger.

Embodiment 2

Figures 1, 3:
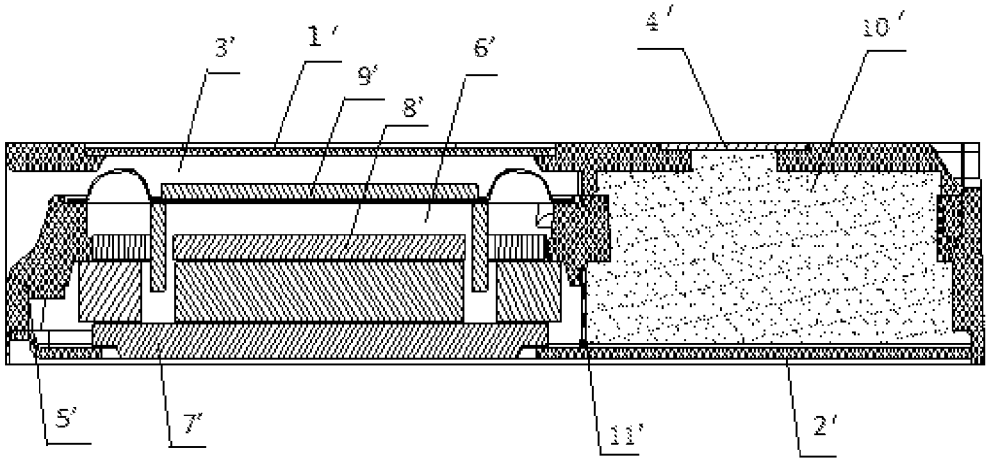
Figures 2, 3:
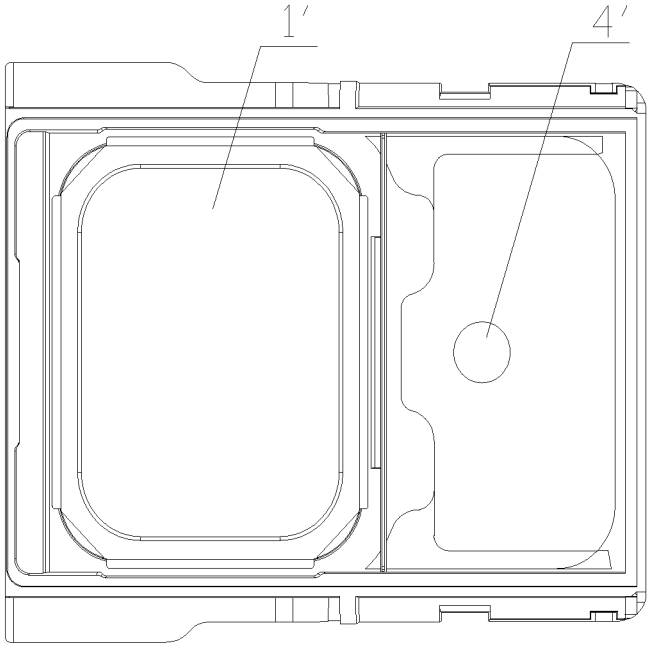

FIG. 3-1 shows a sectional structure of a speaker module according to a second embodiment of the present invention. FIG. 3-2 shows a top view structure of a speaker module according to a second embodiment of the present invention.

As shown in FIGS. 3-1 and 3-2, a speaker module according to a second embodiment of the present invention comprises a housing 2' and a speaker unit 3' accommodated in the housing 2'.A sound hole is arranged on the housing 2'. In order to enlarge the size of a speaker magnetic circuit system, a steel sheet 1' is injection-molded on the housing 2', the front sound cavity communicates with the sound hole, and the rear sound cavity is sealed; a damping hole 4' is provided at a position on the housing 2' corresponding to a rear sound cavity. A damping net is provided at a position on the housing 2' corresponding to the damping hole 4', so as to prevent external small particulate pollutant from entering the interior of the speaker unit, and at the same time avoid a direct impact on the vibrating diaphragm by the airflow and ensure the acoustic performance of the speaker unit during use.

The speaker unit comprises a unit housing 5', a magnetic circuit system 6' accommodated in a cavity formed by the unit housing 5', and a vibrating system. The magnetic circuit system 6' includes a magnetic conduction yoke 7' fixed to the unit housing, a magnet arranged at the center of the magnetic conduction yoke 7' and a washer 8' arranged on one side of the magnet far from the magnetic conduction yoke 7'. The vibrating system includes a vibrating diaphragm, a voice coil fixed on one side of the vibrating diaphragm, and a reinforcing part 9' fixed at the center of the vibrating diaphragm. The rear sound cavity is filled with a sound-adsorbing material 10' doped with heteroatoms, and is isolated from the cavity which is not filled with the sound-adsorbing material by a partition net 11'.

In this second embodiment, the sound-adsorbing material is zeolite powder having a silica-alumina mass ratio of 200 or more. The sound-adsorbing material 10' is directly filled into the rear sound cavity of the speaker module, and the sound-adsorbing material 10' is doped with sodium ions through a sodium ion hydrothermal synthesis method. The conditions for reliability test of the speaker module are as follows: thirty sample speaker modules (the rear sound cavity of each speaker module sample is filled a sound-adsorbing material 10' doped with sodium ions), thirty speaker modules with unfilled rear sound cavities, and thirty speaker modules with the rear sound cavities filled with common sound-adsorbing materials, all are energized at 50° C. for 48 hours. The comparison of the test results (the average value of thirty test results are taken respectively) is shown in Table 3 below:

TABLE 3

| Speaker module | F0; unfilled with sound-adsorbing material (unit: Hz) | Filler material type | Filled with sound-adsorbing material F0 (unit: Hz) | F0; after high-temperature energization (unit: Hz) |
|---|---|---|---|---|
| 2 | 1087 | undoped with heteroatoms | 965 | 997 |
| 2 | 1092 | doped with heteroatoms | 973 | 984 |

From the comparison results in Table 3, it can be seen that the new sound-adsorbing material 10' doped with sodium ions slightly reduces its effectiveness in improving the acoustic performance of the speaker module (F0 becomes higher by 8 Hz), but results from the reliability test (high-temperature energization), the failure rate of the speaker module filled with a sound-adsorbing material undoped with sodium ions is about 26%, and the failure rate of the speaker module filled with a sound-adsorbing material doped with sodium ions is only 9.24%. It can be known that the sound-adsorbing material 3' after heteroatom doping treatment is significantly more stable than the untreated sound-adsorbing material during use of the speaker module.

According to the speaker module of the present invention, the doping of the heteroatoms will reduce the effect in improvement of acoustic performance of the speaker by the sound-adsorbing material to a certain extent. This is mainly because the doped heteroatoms may have a destructive effect on the crystal structure of the original sound-adsorbing material. As a result, the pore-channel structure of the material is changed, and the effect of improving the acoustic performance of the miniature speaker is deteriorated. However, the slight doping of heteroatoms will only reduce the improvement effect by about 5%. Seen from the results of the reliability tests, the addition of heteroatoms can improve the stability of the sound-adsorbing material in improving acoustic performance of the speaker module during long-term energization. Thus, stable performance of the speaker during a long period of use, a simple process and an apparent effect are ensured.

The speaker module according to the present invention is described above by way of example with reference to the accompanying drawings. However, those skilled in the art should understand that, for the speaker module proposed by the present invention described above, various improvements can be made without departing from the content of the present invention. Therefore, the scope of the present invention is subject to the attached claims.

The invention claimed is:

1. A speaker module, comprising a housing and a speaker unit accommodated in the housing, wherein the speaker unit separates a cavity formed by the housing into a front sound cavity and a rear sound cavity;

a sound-adsorbing material is filled in the rear sound cavity, the sound-adsorbing material is an artificial synthetic zeolite which includes a silicon element and an aluminum element, the mass ratio of silicon to aluminum in the artificial synthetic zeolite is 200 or more; and a crystal structure of the sound-adsorbing material is doped with heteroatoms, the heteroatoms fill lattice defects of the crystal structure of the sound-adsorbing material to reduce adsorption and combination of alien molecules by the sound-adsorbing material, or the heteroatoms partially replace original one or more chemical elements in the sound-adsorbing material to change or cancel the polarity of the sound-adsorbing material;

wherein the heteroatoms generate a repulsive force on alien molecules adsorbed by the sound-adsorbing material.

2. The speaker module according to claim 1, wherein the heteroatoms are sodium ions or arsenic ions.

3. The speaker module according to claim 1, wherein the heteroatoms are doped in the sound-adsorbing material by a replacement method or a hydrothermal synthesis method.

4. The speaker module according to claim 3, wherein the heteroatoms partially replace original elements in the sound-adsorbing material or fill defective elements in the sound-adsorbing material.

5. The speaker module according to claim 3, wherein a highly volatile compound containing the dopant atoms and the sound-adsorbing material are placed in an environment with a certain temperature to be subjected to a solid-phase reaction to form a sound-adsorbing material doped with the heteroatoms.

6. The speaker module according to claim 3, wherein a compound containing the heteroatoms is added to a raw material for synthesizing the sound-adsorbing material, and a crystallization reaction is performed to form a sound-adsorbing material doped with the heteroatoms.

7. The speaker module according to claim 1, wherein the heteroatoms are chemical elements or a group of atoms having a property similar to that of silicon element or aluminum element.

8. The speaker module according to claim 7, wherein the property of the doped heteroatoms is similar to that of silicon element, and the heteroatoms are arsenic ions.

9. The speaker module according to claim 7, wherein the property of the doped heteroatoms is similar to that of aluminum element, and the heteroatoms are sodium ions.

10. The speaker module according to claim 1, wherein the heteroatoms partially replace silicon or aluminum element in a zeolite frame to form a new frame.

11. The speaker module according to claim 1, wherein the heteroatoms fill defective elements in the zeolite frame to form a new frame.

12. The speaker module according to claim 1, wherein a sound hole is provided on the housing, the front sound cavity communicates with the sound hole, and the rear sound cavity is sealed; and a damping hole is disposed in a position on the housing corresponding to the rear sound cavity, and a damping net is disposed at a position of the housing corresponding to the damping hole.

13. The speaker module according to claim 1, wherein the speaker unit comprises a unit housing, a magnetic circuit system and a vibration system accommodated in a cavity formed by the unit housing;

the magnetic circuit system includes a magnetic conduction yoke fixed to the unit housing, a magnet disposed at a central position of the magnetic conduction yoke, and a washer disposed on a side of the magnet away from the magnetic conduction yoke; and the vibration system includes a vibrating diaphragm, a voice coil fixed on one side of the vibrating diaphragm, and a reinforcing part fixed at a central position of the vibrating diaphragm.

* * * * *